US006666157B1

(12) United States Patent
Ganon

(10) Patent No.: US 6,666,157 B1
(45) Date of Patent: Dec. 23, 2003

(54) FLATBED SEWING MACHINE CONVERSION FOR SEWING THE RIM OF A MOLDED SOLE TO AN UPPER

(76) Inventor: Michael H. Ganon, 7200 Keystone Ranch Ct., Blacklick, OH (US) 43004

( * ) Notice: Subject to any disclaimer, the term of this patent is extended or adjusted under 35 U.S.C. 154(b) by 0 days.

(21) Appl. No.: 10/200,856

(22) Filed: Jul. 23, 2002

(51) Int. Cl.[7] ..... D05B 15/02
(52) U.S. Cl. ..... 112/28
(58) Field of Search ..... 112/28, 34, 36, 112/39, 52, 54, 60, 61, 62, 153, 235, 324, 260, 475.08; 38/84, 25 R; 12/4.1, 7.7, 13.2, 17 R, 17.2, 57.6, 142

(56) References Cited

U.S. PATENT DOCUMENTS 2,411,855 A * 12/1946 Graff ..... 112/62
2,515,585 A * 7/1950 Bisignano ..... 112/153
3,683,508 A * 8/1972 Kalish ..... 33/626
4,620,495 A * 11/1986 Ganon ..... 112/320
4,991,526 A * 2/1991 Jeanblanc ..... 112/227

* cited by examiner

*Primary Examiner*—Ismael Izaguirre
(74) *Attorney, Agent, or Firm*—Mueller and Smith, LPA

(57) ABSTRACT

A basic flatbed sewing machine is converted to provide an elevated sewing surface at a sewing station which is configured to receive the rim of a molded sole for sewing attachment with an upper. The top feed of the machine performs in conjunction with the elevated sewing surface and a material advancing component of a modified feed dog advances the sole at the surface opposite the rim. Thread breakage is avoided through utilization of a thread sequestration channel extending from the feed dog to a needle receiving opening adjacent the elevated sewing surface.

20 Claims, 4 Drawing Sheets

FLATBED SEWING MACHINE CONVERSION FOR SEWING THE RIM OF A MOLDED SOLE TO AN UPPER

CROSS-REFERENCE TO RELATED APPLICATIONS

STATEMENT REGARDING FEDERALLY SPONSORED RESEARCH

Not applicable.

BACKGROUND OF THE INVENTION

The very wide acceptance of sports oriented molded rubber sole footwear over the past few decades has prompted the shoe production industry to expand the involved technology to a broader range of shoe products. Appealing features of the molded soles are, for instance, their comfort, their enhanced frictional engagement with walking surfaces and their immunity from deterioration when they become wet. Comfort is established by molding the interior of the sole with lower durometer and thus softer material which is 3-dimensionally contoured to support the foot with a shaped heel cradle, arch support and toe grip. Outside portions of the molded soles then are formed with a stiffer, higher durometer value material to establish desired strength or robustness. The resultant molded sole typically will exhibit a maximum thickness of about ⅝ inch at the heel-arch region, such thickness diminishing or tapering non-uniformly toward the toe region to a thickness of about ⅜ inch or less. To assemble the shoe products, for example, fashioned as slippers, it is necessary for sewing machine operators to sew a preassembled cloth upper to the molded relatively thick soles. Attachment of the upper is made at an integrally molded continuous rim extensible outwardly from either the top or bottom of the molded sole. Such sewing attachment may be carried out directly or using such fabrication procedures as "stitch and turn".

Heretofore, the requisite sewing attachment procedure has posed a fabrication cost barrier for a variety of reasons. Basic ubiguitous flatbed industrial sewing machines available in essentially all factories have sewing surfaces which will be located below the necessarily elevated molded sole rim. Thus, without more, they are incapable of carrying out the sewing task. Somewhat specialized sewing machines such as cylinder or post machines are incapable of performing this necessary task inasmuch as the operator is unable to hold and align the work pieces for sewing and the stitching will be improperly positioned due to the inherent design of the machines. Further, the cost of providing the factory floor with customized sewing machines would be prohibitive both in terms of machine cost and operator training.

To produce these new shoe products at acceptable costs, it is necessary that a custom retrofit of the basic flatbed sewing machine be achieved at a practical cost level. In the latter regard, the retrofit must be carried out without altering the camming mechanisms or stroke of the machines and the machines must be easily reconvertible to their initial basic status. This alteration to the original structuring of the machines is necessary, inasmuch as the products may be produced on the production floor for relatively shorter intervals, for example, about three months. Following those intervals, then the machines are returned to fabrication of more conventional products.

Efficiencies of production also are predicated upon the type of task required of the machine operators. In this regard, the hand aligned molded sole and cloth upper must be held together and advanced through the sewing station. This generally calls for holding the entire assemblage with two hands as the bottom of the sole is slid over a flat support surface. It is necessary that the operator assert a slight downward pressure during this sliding maneuver and not be called upon to support the assemblage entirely with the hands. Lack of such full hand support not only results in relatively poor quality stitching but also induces unacceptable operator fatigue. The noted necessity of sliding the sole over a support surface also poses the inherent problem that the molded sole will have been structured to resist sliding activity.

BRIEF SUMMARY OF THE INVENTION

The present invention is addressed to method and apparatus wherein a basic flatbed sewing machine design is converted for sewing through a thick workpiece such as a molded rubber sole having a sewing rim extending from either its top or bottom surface. To connect such a sole with an upper by a stitching procedure, the design facilitates the operational tasks of the sewing machine operator, permitting the holding of the two pieces to be joined with both hands and permitting the thus joined and aligned assemblage to be held down against a work surface as well as an upstanding guide surface. This arrangement achieves both accurate and desirably positioned stitching and results in less operator fatigue and substantial minimization of any opportunity for "kick-out" of the workpieces being joined together.

With the approach of the invention, preexisting basic sewing machines can be retrofitted very simply, for example, using a screwdriver, at relatively low cost inasmuch as the drive mechanisms of the basic machine, for example, incorporating cam actuation and the like are not altered. Correspondingly, the stroke of the machine is not altered. Thus, sewing machines with which operators are already familiar may be retrofitted for the production of footwear such as slippers or the like with relatively thick molded rubber soles and cloth uppers for a given production interval, for example, three months. Following that interval, the machines readily are converted back to their original structuring for production of a next product. As a consequence of the resultant low cost tooling for these specific products, cost of the products themselves are substantially reduced to the extent that superior products are cost competitive with preexisting inferior ones.

Successful conversion is achieved inter alia, through the utilization of a conversion feed dog assembly incorporating a conventional workpiece advancing component which performs at the original flatbed level but also includes an upstanding thread sequestering channel through which the needle of the machine passes in which, in particular, during a down stroke extending through the workpieces being sewn together avoids thread breakage by maintaining the lockstitch forming thread loop at a size avoiding thread breakage when operationally associated with a rotating sewing hook. The cover plate is reconfigured such that it incorporates a platform-like structure with an outwardly disposed guide surface and an upwardly disposed elevated sewing surface carrying a needle receiving slot. Thus beneath or adjacent to this slot resides the needle receiving opening of the conversion feed dog thread sequestration channel. Accordingly, where the platform height corresponds with the bottom of rim to opposite side of a molded sole at its maximum thickness, the side of the sole opposite the rim may be advanced against friction by the workpiece advancing component of the feed dog while the rim is advanced at the elevated sewing surface by the top feed mechanism of the machine. To aid the operator in holding the aligned workpieces together and in proper position at the sewing station of the machine, an auxiliary working surface component is provided which is mounted upon the sewing machine outwardly from the conversion cover plate. This surface is slightly canted upward as it extends outwardly to aid in positioning the workpiece against the upwardly extending cover plate guide surface. The original stroke of the sewing machine is maintained through the utilization of a needle of a type wherein the eyelet is spaced quite closely to the tip as compared to a more conventional needle. Additionally, an edge guide may be installed inwardly of the sewing station of the machine to engage the outer periphery of the rim of the molded sole to thus position the stitching line or locus uniformly from that periphery. For molded sole structures having the rim extending from a bottom surface, an alignment guide, again installed inwardly of the sewing station may be provided which engages the rim to align it with the level of the elevated sewing surface prior to its advancement thereon.

In one aspect, the invention provides a method of converting a sewing machine having a flatbed sewing surface, a sewing station with given stroke, a needle, a lower disposed bobbin and sewing hook, compound feed components having a given extent of reciprocal travel including a reciprocal feed dog, a cover plate, an upper feed and a presser foot for sewing the rim of a molded sole of given rim to bottom thickness to an upper which comprises the steps of:

Providing a cover plate conversion assembly having a lower plate portion with a dog receiving slot, an edge guide having a guide surface extending upwardly and generally normally to the lower plate portion to an elevated sewing platform surface generally parallel to the lower plate portion and having a needle or receiving slot formed therein;

providing a conversion dog assembly having a workpiece advancing component configured for reciprocal movement within the dog receiving slot and a thread sequestering channel component adjacent to and extending upwardly from the advancing component to a needle receiving opening located for reciprocal movement adjacent the needle receiving slot of the conversion cover plate assembly;

removing the cover plate;

removing the feed dog;

installing the conversion feed dog assembly in place of the feed dog; and installing the conversion cover plate assembly in place of the cover plate, the edge guide surface being located in the spaced adjacency with the thread sequestering channel component and the needle receiving opening being located adjacent the needle receiving slot.

Another feature and object of the invention is to provide a kit for converting a sewing machine of a variety having a flatbed sewing surface, a sewing station with a given stroke, a presser foot, a top feed mechanism, a needle, a lower disposed bobbin and sewing hook, a feed dog drive mechanism with a removably connected feed dog, and a removable cover plate, such conversion providing for carrying out the sewing together of first and second workpieces, the first workpiece having a thickness portion of at least about ¼ inch between top and bottom surfaces and further having a rim extending outwardly from one of the top and bottom surfaces, the second workpiece having a peripherally disposed portion for sewing attachment with the rim. The kit comprises:

A conversion cover plate assembly configured for mounting in place of the removable cover plate, having a lower plate portion locatable in alignment with the flatbed sewing surface, having a feed dog workpiece advancement component receiving slot, an edge guide having a guide surface generally extending upwardly normally to the lower plate portion a distance corresponding with the first workpiece thickness portion to an elevated sewing surface configured for operation with the top feed mechanism and presser foot of the sewing machine and being generally parallel with the lower plate portion and including a needle receiving slot; and a conversion feed dog assembly configured for mounting upon the feed dog drive mechanism in place of the removably connected feed dog, including the workpiece advancing component and a thread sequestering channel component adjacent to the workpiece advancing component and extending upwardly a distance generally corresponding with the guide surface distance to a needle receiving opening and located for operably associating the needle and the sewing hook of the sewing machine.

A further feature and object of the invention is to provide a sewing machine for stitching together first and second workpieces, the first workpiece have a thickness portion of at least about ¼ inch between top and bottom surfaces and having a rim extending outwardly from one of the top and bottom surfaces, the second workpiece having a peripherally disposed portion for sewing attachment with the rim. The sewing machine comprises a flatbed defining a first work surface, an arm extending outwardly over the flatbed to a compound sewing mechanism including a compound reciprocating needle and top feed mechanism and a height adjustable presser foot. A bobbin and sewing hook are mounted for actuation below the first work surface for operational association of bobbin fed thread with needle carrying thread to define a sewing station. The cover plate assembly is provided having a lower plate portion at the first work surface with a feed dog workpiece advancing component receiving slot, an edge guide having a guide surface generally extending upwardly normally to the lower plate portion a distance corresponding with the first workpiece thickness portion to an elevated second work surface operable with the top feed mechanism and presser foot and which is generally parallel with the first work surface and includes a needle receiving slot. A feed dog assembly including the workpiece advancing component is provided, the latter component being extensible through the receiving slot of the cover plate assembly and a thread sequestering channel component is provide adjacent to the workpiece advancing component which extends upwardly to a needle receiving opening located for reciprocatory movement adjacent the needle receiving slot at the second working surface. A sewing drive mechanism is provided for carrying out the actuation of the needle, top feed mechanism, bobbin, sewing hook and feed dog assembly.

Other objects of the invention will, in part, be obvious and will, in part, appear hereinafter. The invention, accordingly, comprises the method and apparatus possessing the construction, combination of elements, arrangement of parts and steps which are exemplified in the following detailed description.

For a fuller understanding of the nature and objects of the invention, reference should be made to the following detailed description taken in connection with the accompanying drawings.

DETAILED DESCRIPTION OF THE INVENTION

The sewing machine retrofit feature of the invention functions, in effect, to elevate the sewing or working surface of a conventional, flatbed, basic sewing machine without incurring excessive costs. In this regard, there is no alteration of the stroke of the machine as would involve camming changes and the like. With the elimination of such complexity, the basic sewing machine can be returned, for example after three months working with molded soles, to other products not requiring the elevated surface, again at minimal cost and, in general, through the simple utilization of a screwdriver. In concert with this working or sewing surface elevation the retrofit achieves solution to a resultant operational defect otherwise evoking thread breakage and solves the workpiece retention difficulties otherwise encountered with molded rubber soles.

Figure 1:
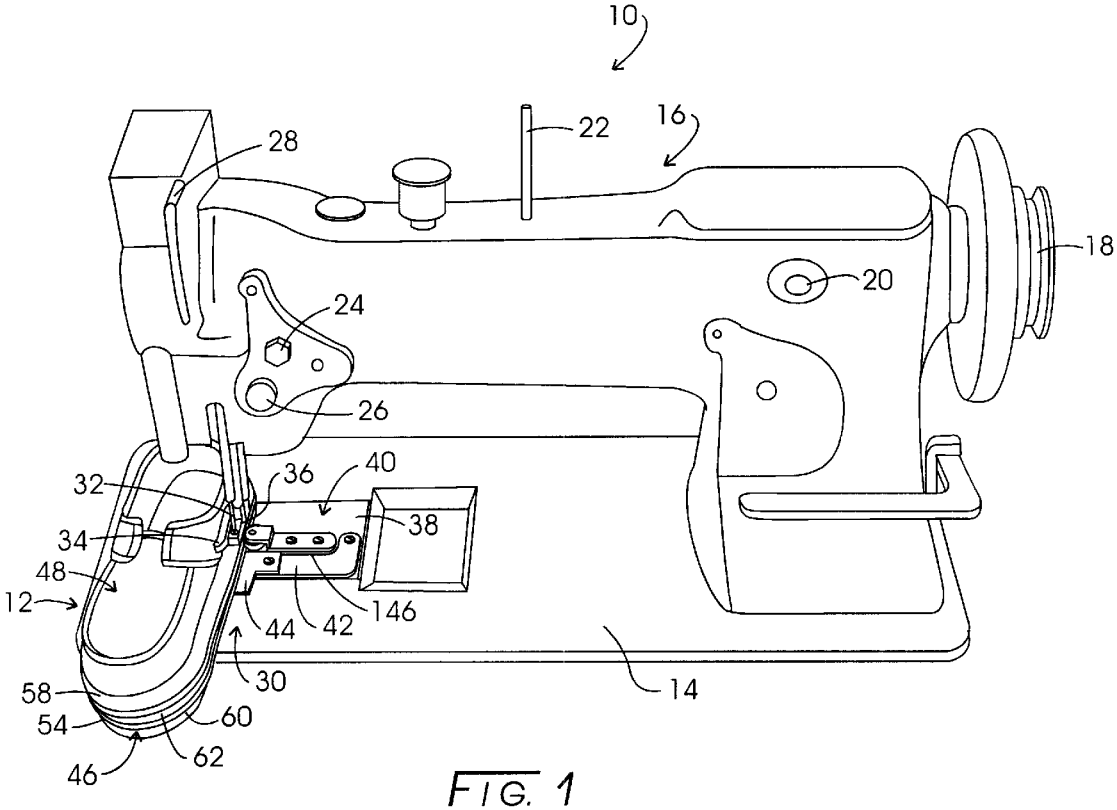
FIG. 1 is a perspective view of a flatbed basic sewing machine having been converted according to the invention and illustrating its operation in sewing a cloth slipper upper to a molded rubber sole.

FIG. 1 reveals the salient features of the ubiguitous flatbed industrial sewing machine as it is converted or modified according to the invention. The sewing machine is depicted in general 10 as it is in the process of producing a slipper 12. Illustrated machine 10 is, for example, a model LU-562 produced by Tokyo Juki Industrial Co., Ltd. of Tokyo, Japan. The machine 10 is seen to have a flatbed 14 over which is supported an arm represented generally at 16. Rearwardly, the machine 10 incorporates a hand wheel 18 and a feed graduation plate 20. Forwardly on the arm 16 is a thread guide bar 22, thread pressure nut 24, spring guide disc 26, and a take-up lever 28. The sewing station for the compound form of sewing activity of machine 10 is represented by the arrow 30 and, in the instant figure, reveals a needle 32, presser foot 34 and L-shaped upper feed 36 through which the needle 32 is extensible. A bobbin cover plate is shown at 38 upon which are mounted a rim edge guide shown generally at 40 and a retractable rim alignment guide 41 which is pivotally mounted to plate 38 at 42 and includes a generally L-shaped rim engagement and aligning plate 44. Alignment guide 41 may be retracted from involvement at the sewing station 30 by rotation about the pivot 42. The guide 41 is employed in particular with rim and molded sole structures wherein the rim extends from the bottom surface of the sole and therefore is flexed for alignment with a sewing platform prior to sewing.

Figure 2:
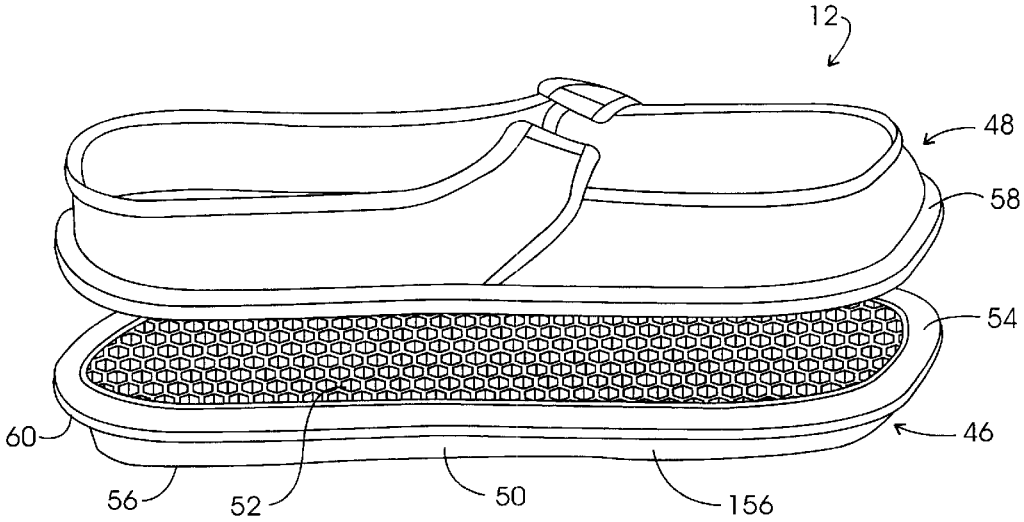
FIG. 2 is an exploded perspective view of the slipper shown in FIG. 1 illustrating a molded rubber sole and a cloth upper.

Looking additionally to FIG. 2, the slipper 12 is illustrated in perspective and exploded fashion. The slipper model 12 is seen to be formed with a molded rubber sole represented generally at 46 to which is sewn a prefabricated cloth upper represented generally at 48. Molded sole 46 is formed with two rubber components of differening durometer. In this regard, sole 46 incorporates a somewhat outwardly disposed higher durometer outer portion 50 within which there is formed a softer, lower durometer honeycomb format formed interior part 52. Note, that for the present embodiment, the molded sole 46 at its upward surface is configured with an integrally formed outwardly extending rim 54. Typically, the bottom or ground engaging surface of the sole 46 as shown at 56 will extend varying distances below the corresponding bottom surface 58 of rim 54. The molded sole typically will be thicker, for example, about ⅝" in the heel and arch region and will taper to about ¼" in thickness toward the toe region. Cloth upper 12 is seen having a continuous connector ledge 58 extending about its lower surface. It is the function of the retrofitted sewing machine 10 to sew the ledge 58 to the rim 54 while holding the upper 48 in alignment with the sole 46. This procedure is generally represented in FIG. 1 wherein a slight gap 60 is shown between the unsewn upper 48 and sole 46 as the slipper 12 is being maneuvered through sewing station 30. Note that the sole 46 bottom surface 56 is in adjacency with the working surface level of the bed 14 while the conjoined rim 54 and ledge 58 are elevated above that surface.

Figure 3:
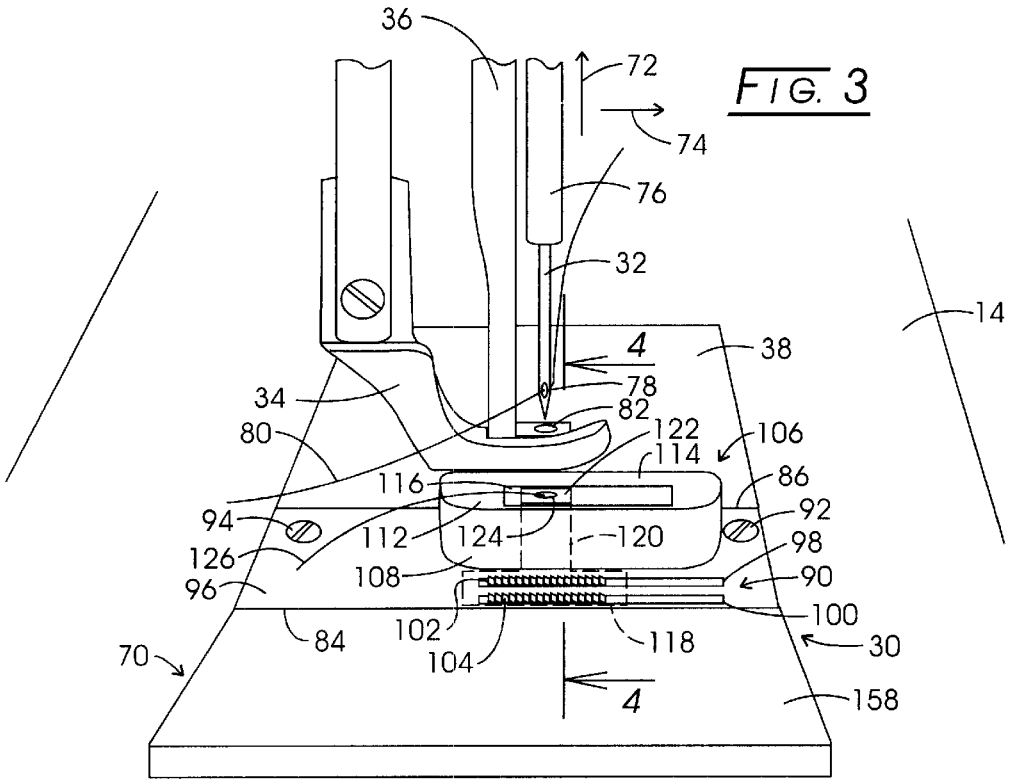
FIG. 3 is a partial perspective view of the sewing station and a slanted auxiliary work surface associated therewith, the components of the sewing station being represented in a mode wherein the needle is moving upwardly and in a recovery orientation horizontally.

Looking to FIG. 3, flatbed 14 is illustrated in conjunction with the sewing station 30; rearwardly extending plate cover 38; and a forwardly extending and inwardly sloping auxiliary working surface component represented generally at 70. The figure reveals the orientation of needle 32 and upper feed 36 as the needle 32 is moving upwardly, as represented at arrow 72, and toward the operator as represented at arrow 74. Needle 32 is shown removably connected to needle drive member 76. For the retrofit at hand, the needle 32, while a typical one, is selected having a foreshortened shank portion to provide a shaft length increase of about ⅛". Note additionally, that the center of the needle eye 78 through which spool supplied thread 80 passes is closer to the tip or point than needles employed for the conventional use of the sewing machine 10. This achieves a maximum utilization of the available stroke of the mechanism of the device. Such needles may be type 135X16 or 175X3. The tip of the needle 32 is shown poised above the aperture 82 within the horizontal leg of upper feed 36. Note, additionally, that using conventional machine adjustment procedures, the presser foot 34 has been elevated as earlier illustrated in connection with FIG. 1. Mounted in the manner of a conventional cover plate between the inward edge 84 of working surface 70 and the forward or outward edge 86 of cover plate 38 is an elevated sewing surface cover plate assembly represented generally at 90.

Attached to the bed 14 with two machine screws 92 and 94 the assembly 90 is formed having a lower plate portion 96, the upward surface of which is substantially coplanar with the upper surface of cover plate 38 and bed 14. Within that lower plate portion are two elongate dog receiving slots 98 and 100 through which protrude the multi-tooth or serrated gripper or workpiece advancing components 102 and 104 of a customized feed dog. Not shown are the blocking teeth components formed within cover plate 90 and which perform in concert with workpiece advancing components 102 and 104.

Cover plate 90 further is configured supporting a generally tower or platform-like structure shown generally at 106. Structure 106 is configured having an outwardly disposed edge guide 108 with a surface 110 extending upwardly and generally normally to the lower plate portion 96. Edge guide 108 forms a portion of the support of an elevated sewing platform 112 the upper surface of which at 114 is disposed generally in parallel with the upper surface of lower plate portion 96. An elongate, rectangular needle receiving slot 116 is shown formed within the platform 112.

The feed dog assembly for the instant application is customized for utilization with the elevated sewing surface and is shown partially in phantom at 118 as not only supporting the workpiece advancing components 102 and 104, but also supporting and reciprocally actuating a tube-like thread sequestering chamber component shown partially in phantom at 120 which is seen to extend into adjacency with slot 116 at upper surface 122. A cylindrical opening extends as a channel fully through the tube-like thread sequestering component 120, the upward aperture or opening thereof being seen in the figure at 124. Note that bobbin supplied thread 126 is shown emerging from the upward opening 124.

Figure 7:
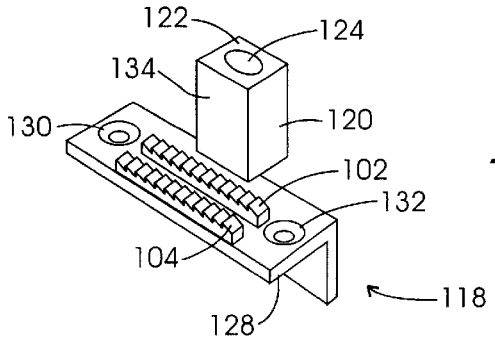
FIG. 7 is a perspective view of a conversion feed dog according to the invention.

Looking momentarily to FIG. 7, the one piece feed dog assembly 118 is revealed in perspective fashion. Assembly 118 includes an angle-form base 128 functioning to support the grippers 102 and 104 as well as the overlapping support of thread sequestering component 120. This provides clearance for the internal channel, the upward opening of which is seen at 124. Feed dog 118 is attached to the cam actuated drive mechanism of the sewing machine 10 through conventionally spaced machine screws, the openings therefore being revealed at 130 and 132.

The channel or passageway within thread sequestering component 120 for use in fabricating shoe products as described in conjunction with FIG. 2 will have a width-wise extent of about 3/32 inch and a principal diametric extent of about 1/8 inch. Structure 120 itself can be employed with a square cross-sectional dimension of about 5/16 inch and the forward or outward edge of the opening 124 will be spaced from the forward surface 134 about 13/64 inch. In general, the upstanding height or lengthwise extent of component 120 will be about 7/16 inch, again for the application represented in FIG. 2. That dimension in general will correspond with the distance from the bottom surface 56 of molded sole 46 to the underside surface 58 of rim 54 as that distance is of maximum value for the sole, for example, in the heel-arch region.

Figure 4:
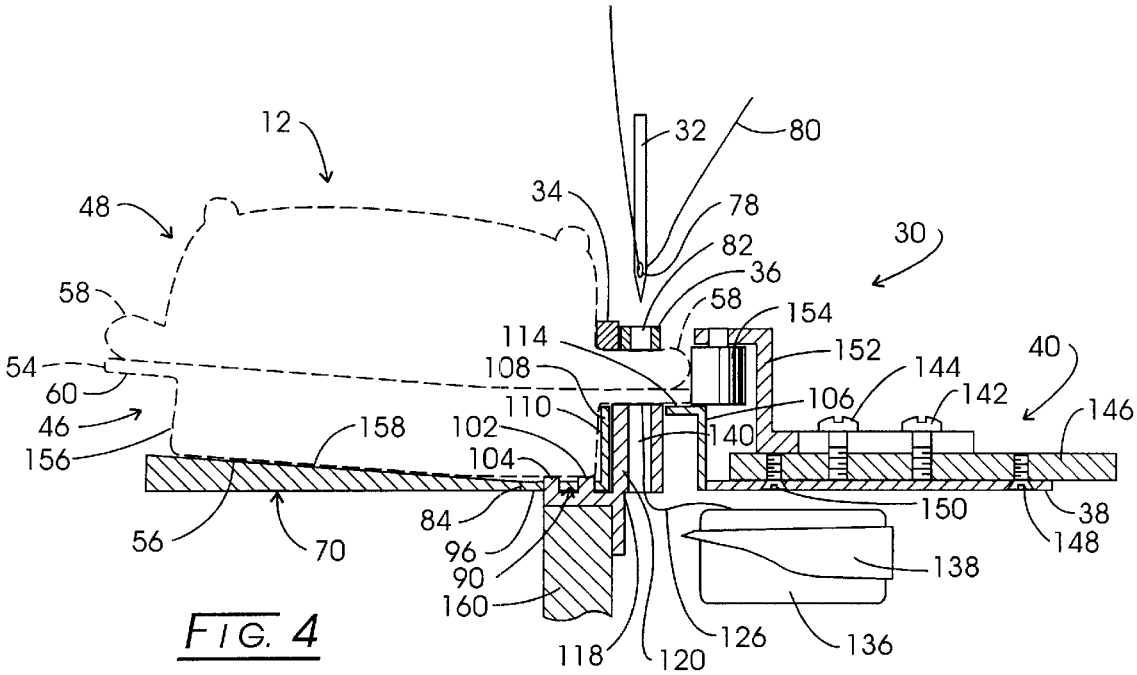
FIG. 4 is a sectional view taken through the plane 4—4 shown in FIG. 3.

Turning to FIG. 4, a sectional portrayal of the feed dog assembly 180, cover plate assembly 90 and auxiliary working surface component 70 is provided in conjunction with a cross-sectional representation of the molded sole 46 and upper 48 of slipper 12. In the figure, a bobbin assembly 136 is revealed at 136 in an orientation wherein bobbin rotation is about a vertical axis. Associated operationally with the bobbin 136 is a sewing hook 138 and the bobbin thread again is shown at 126 extending through the interior channel 140 of thread sequestering component 120. Rim edge guide 40 is connected to cover plate 38 by machine screws 142 and 144 and is seen having a upwardly depending angular portion 146 extending over and supporting a guide roll 148. Guide roll 148 is seen to be positioned adjacent the upper surface 114 of tower-like structure 106. As the operator, using two hands, maneuvers the two-component workpiece through sewing station 30, presser foot 34 and upper feed 36, when engaged, will tend to distort or flatten out the continuous connector ledge 58 of upper 48. The operators' two hands in pushing down on the two-component work piece will urge that portion of the molded sole 46 at 150 extending between bottom 56 and the ridge bottom 58 into engagement against surface 110 of edge guide 108. This task is aided, as is apparent, by the inwardly sloping surface 152 of auxiliary working surface component 70. As this is occurring, the lower surface 58 of rim 54 is positioned over the upper or elevated sewing surface 114. Note that the guide roll 148 is in contact with the outer-periphery of ledge 58 and functions to orient ledge 58 with respect to the needle 32 in a consistent inward spacing manner. Typical spacing will provide a final product wherein stitching is about 1/4 inch inward from the edge of ledge 58. FIG. 4 also reveals the cam actuated mechanical drive 154 to which the feed dog 118 is attached by machine screws extending through openings 130 and 132 (FIG. 7).

Figure 5:
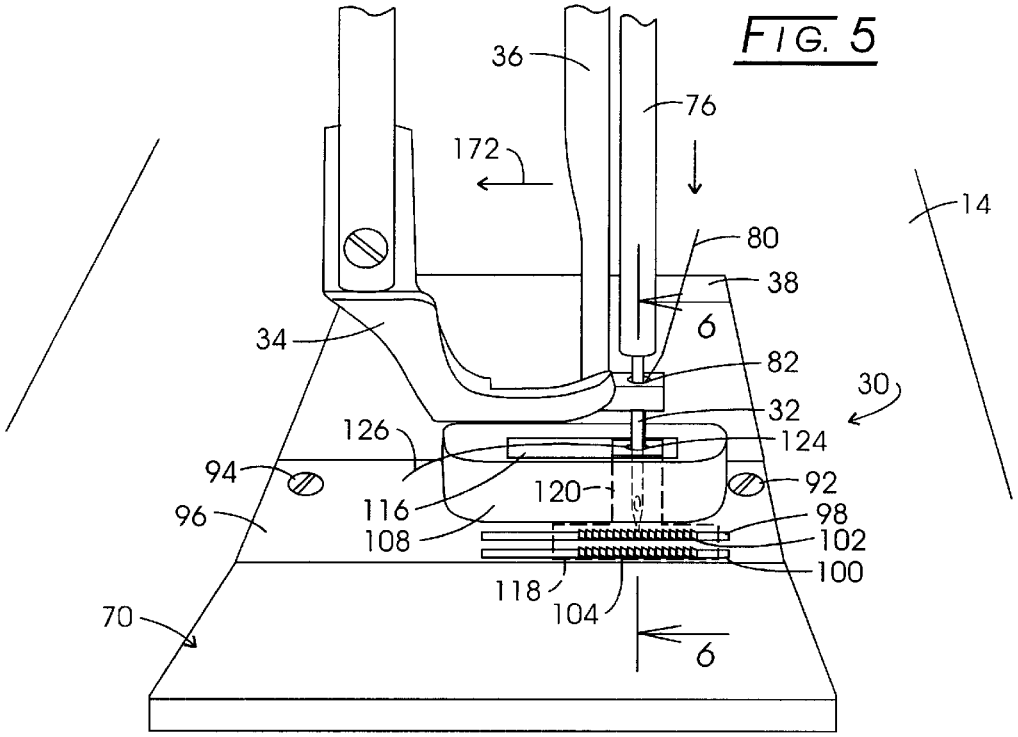
FIG. 5 is a partial perspective view in the manner of FIG. 3 showing an orientation wherein the needle is moving downwardly in a stitch-forming motion.

Referring to FIG. 5, another stage in the compound sewing maneuvers at sewing station 30 is revealed. In the figure, the needle 32 is being driven downwardly as represented at arrow 170 while the needle, upper feed 36 and feed dog 118 are also being driven horizontally in a material advancing direction as represented at arrow 172. Note that the tip of needle 32 is within the thread sequestering component 120 channel and the orientation of workpiece advancing components 102 and 104, as well as connected chamber component 120 are located in a region of commencement of a stitch.

Figure 6:
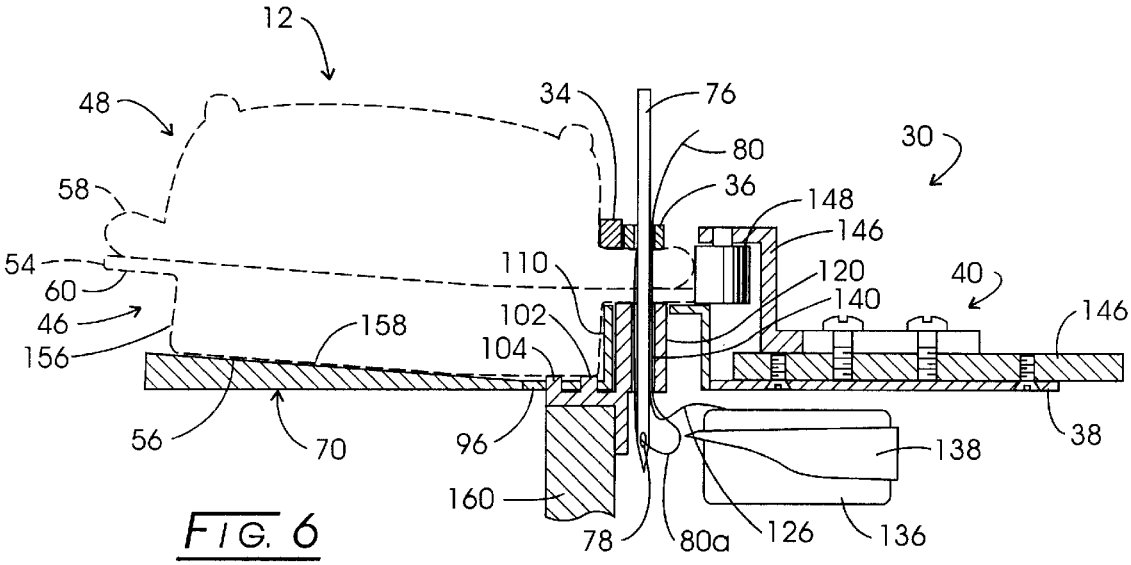
FIG. 6 is a sectional view taken through the plane 6—6 shown in FIG. 5 and illustrating two phantom workpieces being joined.

FIG. 6 reveals a sectional detail of this orientation of FIG. 5 in conjunction with a phantom cross-sectional representation of the sole 46 and upper 48. At this juncture in the procedure, the friction enhancing bottom 56 of molded sole 46 is engaging upper surface 158 of auxiliary working surface component 70. Additionally, it may be recalled that the operator, using both hands, is pushing down and inwardly on the assemblage of molded sole 46 and upper 48 such that the sole lower outer surface 156 beneath the ridge lower surface 60 is in contact with surface 110 of edge guide 108. The frictional engagement of the sole bottom 56 with surface 158 is overcome, however, to provide movement in the noted direction represented by arrow 172 by virtue of the material advancement components 102 and 104, as well as the corresponding movement of forward feed 36 as thinner portions and a lesser height of the side surface 156 are encountered, the sole bottom 56 in the vicinity of advancing components 102 and 104 tends to lift off of them but with a concomitant reduction in overall surface contact with surface 158. Thus, operator fatigue continues to be avoided. It may be observed that with the emergence of the tip of needle 76 below the thread sequestering component 120 a loop in thread 80 will be formed as represented at **80*a*. Loop 80*a* is of correct size for engagement by sewing hook 138 because of the presence of component 120. Without the presence of that component, the loop would be much too large and engaged not once but twice by the sewing hook 138** to break thread.

FIGS. 8A through 8E schematically portray a lock-stitch forming sequence carried out with the conversion or adaptation of a standard flat bed machine as described in the discourse above. For clarity of presentation, the bobbin 136 and sewing hook 138 are shown as rotating about a horizontal as opposed to a vertical axis. Depicted in the drawing is the particularly selected needle 32, the feed forward component 36, thread sequestering component 120, thread 180 and one of the workpiece advancing components as at 104. The stitch is shown being formed within the abutting rim 54 and ledge 58.

Figure 8A:
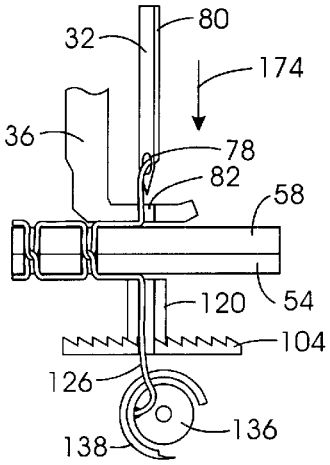
FIGS. 8A–8E schematically illustrate a sequence of operations of a sewing station as modified according to the invention.

In FIG. 8A needle 32 is represented as descending toward the workpiece as represented at arrow 174. Bobbin thread 126 extends through the channel of component 120 to the next previous stitch as does the needle carrying thread 80.

Figure 8B:
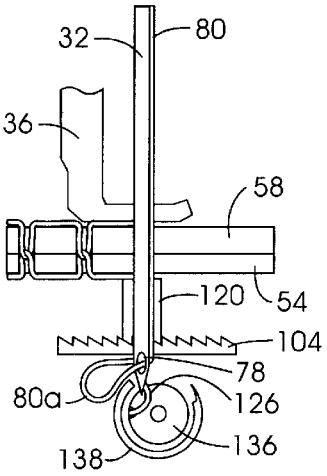
Figure 8C:
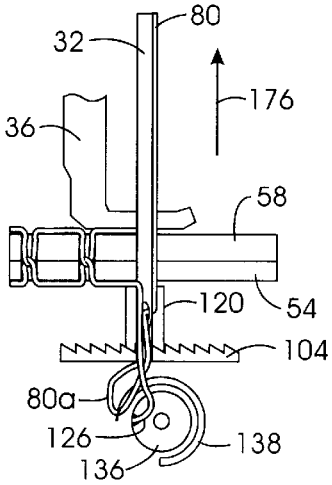

FIG. 8B shows an orientation of needle 32 wherein the tip and the eyelet 78 have descended through the channel of the sequestration component 120 into the vicinity of sewing hook 138. Note that a loop has been formed in thread 80 as represented at 80*a* and that sewing hook 138 has rotated in a counterclockwise fashion and is about to encounter and pass through the loop 80*a*. In developing the retrofit or conversion arrangement of the invention, it was found that the component 120 is quite necessary to avoid forming too large a sewing loop. In effect, the sewing hook 138 would pass through such a large loop twice and break the thread. The loop 80*a* being of proper size, as shown in FIG. 8C and arrow 176, needle 32 has commenced to move upwardly with some tension on the thread 80. At the same time, the leading edge of sewing hook 138 has engaged or passed through loop 80*a*.

Figure 8D:
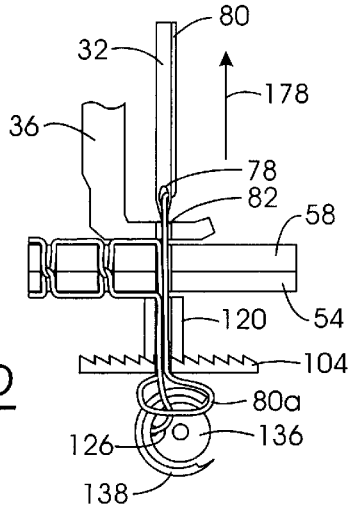

Looking to FIG. 8D, it may be observed, as represented at arrow 178, that the tip of needle 32 has emerged from the opening 82 in forward feed 36 and sewing hook 138 is releasing from the thread loop 80*a* and has caused the bobbin thread 126 to pass through loop 80*a*.

Figure 8E:
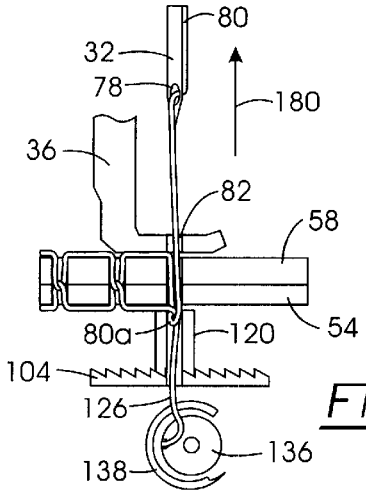

Finally, looking to FIG. 8E, as represented at arrow 180, needle 32 has moved more fully upwardly and the needle thread 80 is being pulled tight by a lever on the sewing machine 10 to form the stitch.

Since certain changes may be made in the above-described apparatus and method without departing from the scope of the invention herein involved, it is intended that all matter contain in the description thereof or shown in the accompanying drawings shall be interpreted as illustrative and not in a limiting sense.

What is claimed is:

1. The method of converting a sewing machine having a flat bed sewing surface, a sewing station with given stroke, a needle, a lower disposed bobbin and sewing hook, a compound feed having a given extent of reciprocal travel including a reciprocal feed dog, cover plate, upper feed and presser foot for sewing the rim of a molded sole of given rim to bottom thickness to an upper, comprising the steps of:

providing a conversion cover plate assembly having a lower plate portion with a dog receiving slot, an edge guide having a guide surface extending upwardly and generally normally to said lower plate portion to an elevated sewing platform surface, generally parallel to said lower plate portion, and having a needle receiving slot;

providing a conversion feed dog assembly having a workpiece advancing component configured for reciprocal movement within said dog receiving slot and a thread sequestering channel component adjacent to and extending upwardly from said advancing component to a needle receiving opening located for reciprocal movement adjacent said needle receiving slot;

removing said cover plate;

removing said feed dog;

installing said conversion feed dog assembly in place of said feed dog; and installing said conversion cover plate assembly in place of said cover plate, said edge guide surface being located in spaced adjacency with said thread sequestering channel component and said needle receiving opening being located adjacent said needle receiving slot.

2. The method of claim 1 in which said conversion cover plate assembly edge guide surface is located about one-fourth inch from said needle at said elevated sewing surface.

3. The method of claim 1 further comprising the steps of:

providing said needle as having an eye opening positioned within about one-eighth inch from its tip.

4. The method of claim 1 further comprising the steps of:

providing an auxiliary working surface component having an inward edge of length generally extensible across said flat bed sewing surface and having a working surface extending from said inward edge to define an upwardly inclined working surface; and installing said auxiliary working surface component over said flat bed sewing surface positioning said inner edge adjacent said conversion cover plate assembly lower plate portion and said upwardly inclined working surface extending outwardly from said sewing station.

5. The method of claim 1 further comprising the steps of:

providing a rim edge guide having a rim guide surface elevated for positioning adjacent to said elevated sewing surface and configured for guiding contact with said rim; and installing said rim edge guide upon said flat bed sewing surface inwardly of said sewing station in a manner positioning said rim guide surface adjacent to and extending upwardly from said elevated sewing platform surface.

6. The method of claim 1 in which:

said conversion feed dog assembly thread sequestering channel is configured to cause the formation of a thread loop of generally conventional size for effective operational engagement by said sewing hook.

7. The method of claim 1 further comprising the steps of:

providing a rim alignment guide having an alignment surface positionable adjacent said elevated sewing platform surface; and mounting said rim alignment guide inwardly of said sewing station and locating said alignment surface to confront and align said rim with said elevated sewing platform surface.

8. A sewing machine for stitching together first and second workpieces, said first workpiece having a thickness portion of at least about one-fourth inch between top and bottom surfaces and having a rim extending outwardly from one of said top and bottom surfaces, said second workpiece having a peripherally disposed portion for sewing attachment with said rim, comprising:

a flat bed defining a first work surface;

an arm extending outwardly over said flat bed to a compound sewing mechanism including a compound reciprocating needle and top feed mechanism, and a height adjustable presser foot;

a bobbin and sewing hook mounted for actuation below said first work surface for operational association of bobbin fed thread with needle carrying thread to define a sewing station with said compound sewing mechanism;

a cover plate assembly having a lower plate portion at said first work surface with a feed dog workpiece advancing component receiving slot, an edge guide having a guide surface generally extending upwardly normally to said lower plate portion a distance corresponding with said first workpiece thickness portion to an elevated second work surface operable with said top feed mechanism, generally parallel with said first work surface and including a needle receiving slot;

a feed dog assembly including said workpiece advancing component extensible through said receiving slot and a thread sequestering channel component adjacent to said workpiece advancing component and extending upwardly to a needle receiving opening located for reciprocatory movement adjacent said needle receiving slot at said second working surface; and a sewing drive mechanism for carrying out the actuation of said needle, top feed mechanism, bobbin, sewing hook, and feed dog assembly.

9. The sewing machine of claim 8 in which said cover plate assembly guide surface is spaced about one-fourth inch from said needle at said second work surface.

10. The sewing machine of claim 8 in which said needle includes an eye opening the center of which is positioned about one-eighth of an inch from its tip.

11. The sewing machine of claim 8 further comprising:

a third working surface assembly extending outwardly from said sewing station and sloping toward it to the level of said first work surface.

12. The sewing machine of claim 8 further comprising:

a rim edge guide positioned adjacent said second work surface inwardly from said needle and forward feed for guiding engagement with the edge of said rim.

13. The sewing machine of claim 8 further comprising:

a rim alignment guide positioned adjacent said second work surface for flexing said rim into alignment with said second work surface as it is advanced thereto.

14. The sewing machine of claim 8 in which:

said feed dog assembly thread sequestering channel is configured to cause the formation of a thread loop of operationally effective size for engagement by said sewing hook.

15. A kit for converting a sewing machine having a flat bed sewing surface, a sewing station with a given stroke, a presser foot, a top feed mechanism, a needle, a lower disposed bobbin and sewing hook, a feed dog drive mechanism with a removably connected feed dog, and a removable cover plate, such conversion providing for carrying out the sewing together of first and second workpieces said first workpiece having a thickness portion of at least about one-fourth inch between top and bottom surfaces and having a rim extending outwardly from one of said top and bottom surfaces, said second workpiece having a peripherally disposed portion for sewing attachment with said rim, said kit comprising:

a conversion plate assembly adapted to be mounted in place of said removable cover plate, having a lower plate portion locatable in alignment with said flat bed sewing surface having a feed dog workpiece advancing component receiving slot, an edge guide having a guide surface generally extending upwardly normally to said lower plate portion a distance corresponding with said first workpiece thickness portion to an elevated sewing surface configured for operation with said top feed mechanism and said presser foot, being generally parallel with said lower plate portion and including a needle receiving slot; and a conversion feed dog assembly adopted to be mounted upon said feed dog drive mechanism in place of said removably connected feed dog, including said workpiece advancing component and a thread sequestering channel component adjacent to said workpiece advancing component and extending upwardly a distance generally corresponding with said guide surface distance to a needle receiving opening and located for operably associating said needle, said bobbin and said sewing hook.

16. The kit of claim 15 in which:

said conversion cover plate assembly edge guide and said conversion feed dog thread sequestering channel component are configured for locating said needle within about one-fourth inch from the outward surface of said guide surface component.

17. The kit of claim 15 further comprising:

an auxiliary working surface component having an inward edge of length generally extensible across said flatbed sewing surface and having a working surface extending from said inward edge to define an upwardly inclined working surface, said auxiliary working surface component being adapted to be mounted over said flat bed sewing surface.

18. The kit of claim 15 further comprising:

a rim edge guide adapted to be mounted adjacent to and inwardly from said sewing station, having a rim guide surface configured for guiding engagement with said rim at the peripheral edge thereof when said rim is advanced across said sewing station at said elevated sewing surface.

19. The kit of claim 15 further comprising:

a rim alignment guide adapted to be mounted inwardly from and adjacent to said sewing station and having an alignment surface positionable adjacent said elevated sewing surface at a location flexing said rim into alignment with said elevated sewing surface as it is advanced thereon.

20. The kit of claim 15 further comprising:

a conversion needle having an eye opening the center of which is positioned about one-eighth of an inch from its tip.

* * * * *